United States Patent [19]

Knight

[11] Patent Number: 5,042,512

[45] Date of Patent: Aug. 27, 1991

[54] APPLICATOR TOOL FOR HAIRDRESSING LOTIONS AND THE LIKE

[76] Inventor: Lois A. Knight, 9818 Reliance Dr., Anchorage, Ak. 99507

[21] Appl. No.: 350,631

[22] Filed: May 10, 1989

[51] Int. Cl.[5] ..... A45D 7/02

[52] U.S. Cl. ..... 132/212; 15/104.5

[58] Field of Search ..... 132/219, 124, 125, 320, 132/202, 212; 15/104.5, 236.01; 128/304; 604/289; 30/85, 53

[56] References Cited

U.S. PATENT DOCUMENTS

| | | | |
|---|---|---|---|
| 237,681 | 2/1881 | Fuller | 15/236.01 |
| 1,007,971 | 11/1911 | Phillips | 15/104.5 |
| 2,245,469 | 6/1941 | Ecklund et al. | 15/236.01 |
| 2,249,267 | 7/1941 | Berry | 132/124 |
| 2,587,389 | 2/1952 | Scheithe | 132/124 |
| 2,670,491 | 3/1954 | Stoner et al. | 15/104.5 |
| 3,325,627 | 6/1967 | Adler et al. | 15/236.01 |
| 3,411,723 | 11/1968 | Kohn | 15/236.01 |

FOREIGN PATENT DOCUMENTS

| | | | |
|---|---|---|---|
| 1566990 | 5/1969 | France | 132/212 |

*Primary Examiner*—Gene Mancene
*Assistant Examiner*—Michael Lynch
*Attorney, Agent, or Firm*—Michael J. Tavella

[57] ABSTRACT

A new form of applicator for hair setting creams or lotions is disclosed. Although this device is shaped like a comb, it has no teeth. The entire head of the applicator is flat and smooth. This allows the hairdresser to use the applicator like an artist uses a palette knife; to apply creams or lotions, smooth it into the hair, and to scrape off any excess. The applicator also has a rat tail handle, typically found on hairdressing combs to allow the hairdresser to work the hair. By alternating between the applicator end and the handle, the hairdresser can quickly and efficiently apply relaxing cream on hair to be straightened, or can separate and curl the hair while applying the setting creams or lotions, without having to stop and change tools.

1 Claim, 1 Drawing Sheet

APPLICATOR TOOL FOR HAIRDRESSING LOTIONS AND THE LIKE

This invention is related to applicators for hairdressing lotions, and particularly to comb-like implements having no teeth and a rat tail feature.

BACKGROUND OF THE INVENTION

For many years hairdressers have used combs of various types to shape and separate hair for curling and setting and straightening. Typically, these operations require applying setting creams or lotions that can have a wide range of viscosity. Hairdressers often combine the shaping and setting steps to save time and are forced to use a standard comb to apply the creams or lotions. Several U.S. patents teach different styles of toothed combs for use in hairstyling. U.S. Pat. No. 3,568,689 discloses a comb that has an open top portion that can be filled with setting lotions. Slots are provided at the top of the comb to allow the creams or lotions to flow into the teeth as the comb is pulled through the hair. U.S. Pat. No. 3,139,092 discloses a ratting comb that has a sharpened handle and a screen placed at the top of the toothed portion. This patent teaches the use of the rat tail for separating the hair and use of the screen for ratting the hair further by using the screen to pull only a few hairs at a time. This screen separates the hair efficiently.

Although these devices work well, they do not efficiently apply creams or lotions on hair to be straightened. People with curly hair often must have the hair relax and straighten before it can be re-set. A toothed comb can be used to spread the creams or lotions, but the teeth will usually tangle in the curls of the hair to be straightened, which slows the technician down. Because the setting solution must be applied quickly, a applicator tool is needed to enable the hairdresser to quickly separate the hair, and apply the creams or lotions without having to stop to change tools or be hampered by a toothed comb.

The present invention overcomes these difficulties by combining a rat tail handle of a standard comb with a flat, solid applicator that has no teeth. The smooth, flat portion of the applicator is used to spread the setting creams or lotions over the curls. It can also be used to catch creams or lotions that drip down off the hair, without having the creams or lotions pour through the teeth. This device can be used much like a painter uses a palette knife when applying paint to a canvas. Unlike an artist, the hairdresser can then turn the applicator around and use the rat tail handle to pull and separate the hair. Thus, the hairdresser can alternate between the rat tail and applicator as the hairdresser works the hair, without having to stop and switch tools. This increases the efficiency of the hairdresser and helps to ensure that the hair will relax uniformly by reducing the time needed to apply the creams or lotions.

The device is intended for use with curly hair that must be straightened. It can, however, also be used with hair rolled in curlers. In this operation, the hair can be rolled in curlers before the setting cream is applied. The device can then be used to spread the cream over the curled hair to ensure that the cream is applied uniformly.

It is an object of this invention to produce a hairdressing applicator for creams or lotions that increases efficiency and reduces the time needed to apply the creams.

It is a further object of this invention to produce an applicator tool that can be used to apply lotions of varying viscosity, keeping spilling and dripping of the creams or lotions to a minimum.

It is yet a further object of this invention to produce an applicator tool that can be used to make an entire set without the need to change to a different comb or tool.

It is yet a further object of the invention to produce a tool that can also be used with curlers to produce a set.

DETAILED DESCRIPTION OF THE PREFERRED EMBODIMENT

Figure 1:
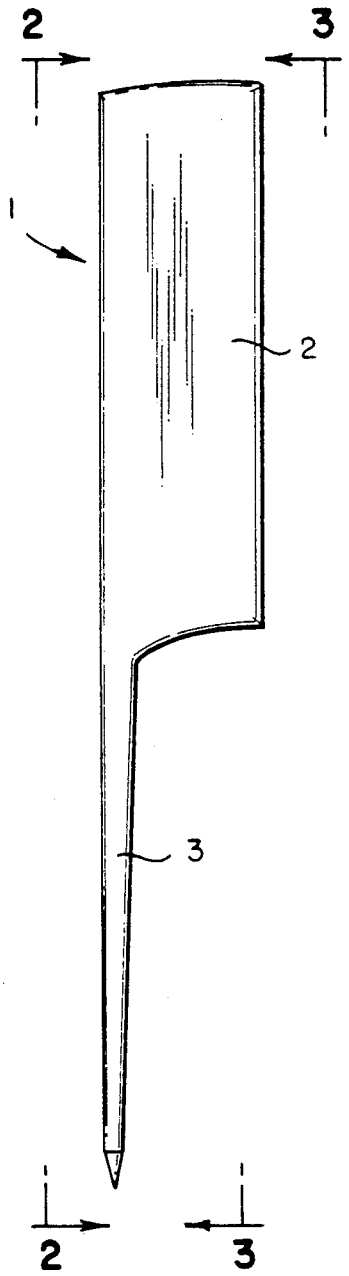
FIG. 1 is a side view of the invention.
Figure 2:
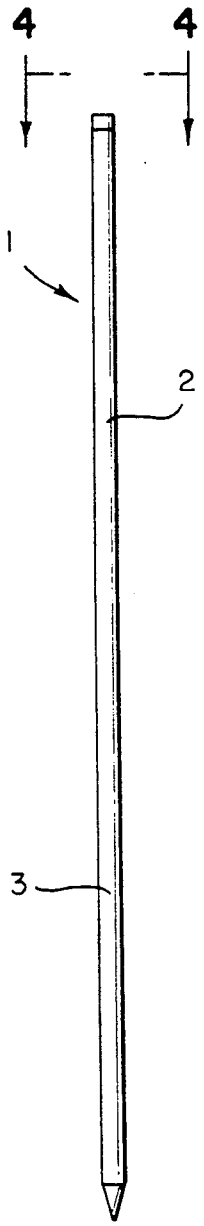
FIG. 2 is a top view of the invention, taken along the lines 2—2.
Figure 3:
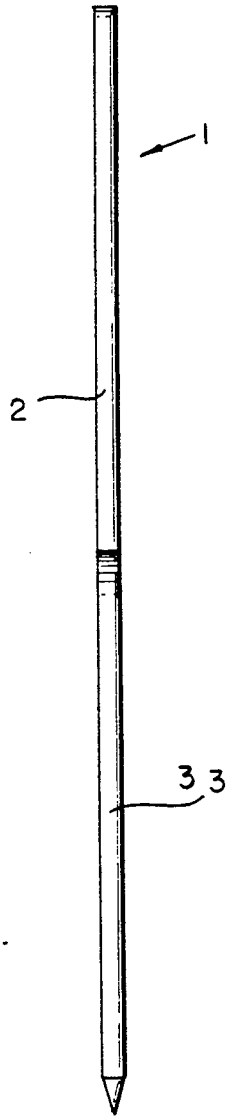
FIG. 3 is a bottom view of the invention taken along the lines 3—3.
Figure 4:
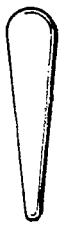
FIG. 4 is a front view of the invention along the lines 4—4, showing the cant of the blade.

Referring now to the drawings, and particularly to FIG. 1, the applicator 1 consists of a flat smooth blade portion 2 and a circular, pointed handle 3. The handle 3 is commonly referred to as a "rat tail" and is used to separate the hair. The flat blade 2 has an overall rectangular shape as shown. It has no teeth, protrusions or other fixtures at the top. The flat blade 2 is canted (see FIG. 4) so that it is wider at the top than at the bottom. However, it is not necessary to cant the blade in this manner. The lack of teeth in the blade allow the blade to glide smoothly over hair or curlers without getting the teeth tangled. The rat tail allows the hairdresser to separate hair using one tool. By changing from the handle to the blade, a hairdresser can quickly partition, and apply the relaxing cream, or can curl the hair and apply the setting creams or lotions with one tool.

The preferred embodiment is made from plastic and would be injection molded or fashioned by techniques common to the art.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An applicator for applying lotions and the like and for partitioning hair comprising:

a) a flat, rigid, generally rectangular blade, having two ends and two sides, the ends being shorter than the sides, said blade also being smooth and having no protrusions or indentations therein; and b) handle means, fixedly attached to said blade and extending longitudinally from one end of the blade, said handle means being generally cylindrical, having a diameter approximately $\frac{1}{4}$ of the length of the end of said blade, and having a pointed end; and whereby a user can partition the hair with the pointed end and apply the lotion using the blade.

* * * * *